US007168766B2

(12) United States Patent
Pelletier

(10) Patent No.: US 7,168,766 B2
(45) Date of Patent: Jan. 30, 2007

(54) CHAIR AND DESK ASSEMBLY

(76) Inventor: Mead Pelletier, 59 Church Rd., Monsey, NY (US) 10952

( * ) Notice: Subject to any disclaimer, the term of this patent is extended or adjusted under 35 U.S.C. 154(b) by 0 days.

(21) Appl. No.: 11/223,265

(22) Filed: Sep. 9, 2005

(65) Prior Publication Data

US 2006/0061191 A1 Mar. 23, 2006

Related U.S. Application Data

(60) Provisional application No. 60/611,560, filed on Sep. 20, 2004.

(51) Int. Cl.
*A47C 7/00* (2006.01)
*A47C 7/16* (2006.01)

(52) U.S. Cl. ..... 297/440.13

(58) Field of Classification Search ..... 297/440.13, 297/440.1, 440.14
See application file for complete search history.

(56) References Cited

U.S. PATENT DOCUMENTS

| | | | | | |
|---|---|---|---|---|---|
| 521,395 | A | * | 6/1894 | Van Norman | 297/440.13 |
| 1,419,647 | A | * | 6/1922 | Shepherdson | 297/440.13 |
| 1,747,900 | A | * | 2/1930 | Jenny | 297/440.13 |
| 1,923,881 | A | * | 8/1933 | Palais | 229/122.21 |
| 2,279,864 | A | * | 4/1942 | Eide | 297/440.13 X |
| 2,334,912 | A | * | 11/1943 | Eide | 297/440.13 X |
| 2,360,963 | A | * | 10/1944 | Meiselman | 297/440.13 X |
| D144,730 | S | * | 5/1946 | Perrault | 297/440.13 X |
| 2,479,086 | A | * | 8/1949 | Silverman | 297/440.13 |
| 2,486,987 | A | * | 11/1949 | Scarlett | 297/440.13 |
| 2,518,955 | A | * | 8/1950 | Stelzer | 297/440.13 |
| 2,534,413 | A | * | 12/1950 | Cenis | 297/440.13 |
| 2,543,875 | A | * | 3/1951 | Silverman | 297/440.13 X |
| 2,632,498 | A | * | 3/1953 | Curtis | 297/440.13 |
| 2,723,788 | A | * | 11/1955 | Lund | 297/440.13 X |
| 2,792,877 | A | * | 5/1957 | West, Jr. | 297/440.13 |
| 3,300,245 | A | * | 1/1967 | Rumble | 297/440.13 X |
| 3,527,497 | A | * | 9/1970 | Self | 297/440.13 |
| 3,547,491 | A | * | 12/1970 | Bovasso | 297/440.13 |
| 3,603,656 | A | * | 9/1971 | Ferman | 297/440.13 X |
| 4,082,356 | A | * | 4/1978 | Johnson | 297/440.13 |
| 4,140,065 | A | * | 2/1979 | Chacon | 297/440.13 X |
| 4,419,028 | A | | 12/1983 | Roland | |
| 4,509,794 | A | * | 4/1985 | Roland | 297/440.13 |
| 4,593,950 | A | | 6/1986 | Infanti | |
| 4,712,837 | A | * | 12/1987 | Swilley | 297/440.13 |
| 4,867,327 | A | | 9/1989 | Roland | |
| 5,000,514 | A | * | 3/1991 | Hanson | 297/440.13 |
| 5,203,611 | A | | 4/1993 | Greenwood | |
| 5,275,467 | A | | 1/1994 | Kawecki | |
| 5,387,027 | A | * | 2/1995 | Maloney | 297/440.13 |
| 5,551,748 | A | * | 9/1996 | McKelvey et al. | 297/440.13 X |
| 5,765,922 | A | * | 6/1998 | Hsia | 297/440.13 X |
| 5,803,548 | A | * | 9/1998 | Battle | 297/440.13 |
| 5,921,631 | A | * | 7/1999 | Bush | 297/440.13 X |
| 5,927,816 | A | * | 7/1999 | Hsu | 297/440.13 |

(Continued)

*Primary Examiner*—Rodney B. White
(74) *Attorney, Agent, or Firm*—Michael E. Zall

(57) ABSTRACT

A chair and desk assembly that is a "knock-down" or "ready-to-assemble" (RTA) structure having members formed from a single sheet of, for example, plywood, that are assembled into interlocking relationship requiring no fasteners for the assembly. The assembly can be readily disassembled and knocked down into a compact form for storage, transportation, or packaging. Optionally, the chair and desk assembly, includes a reading stand, book storage compartment and may be a rocking chair.

10 Claims, 14 Drawing Sheets

U.S. PATENT DOCUMENTS

| | | | | |
|---|---|---|---|---|
| 5,992,938 | A * | 11/1999 | Jones | 297/440.13 |
| 6,109,695 | A * | 8/2000 | Kahwaji | 297/440.13 |
| 6,267,446 | B1 * | 7/2001 | Wieland et al. | 297/440.13 |
| 6,619,749 | B2 | 9/2003 | Willy | |
| 6,807,912 | B2 | 10/2004 | Willy | |
| 6,848,747 | B1 * | 2/2005 | Robinson | 297/440.13 |
| 6,955,401 | B1 * | 10/2005 | Shoulberg | 297/440.13 |
| 7,017,996 | B2 * | 3/2006 | Peterson | 297/440.13 |
| 2003/0107254 | A1 | 6/2003 | Willy | |
| 2003/0107255 | A1 | 6/2003 | Willy | |
| 2004/0000808 | A1 | 1/2004 | Maloney | |
| 2004/0056526 | A1 | 3/2004 | Willy | |

* cited by examiner

CHAIR AND DESK ASSEMBLY

RELATED APPLICATIONS

This application claims the priority of Provisional Application Ser. No. 60/611,560 filed Sep. 20, 2004, the entire disclosure of which is incorporated herein by reference.

BACKGROUND OF THE INVENTION

1. Field of the Invention

The present invention generally relates to the field of furniture, and in particular, to a chair and desk assembly having members formed from a single sheet of, for example, conventional plywood, that are assembled into interlocking relationship requiring no fasteners for the assembly. More particularly, this invention relates to a chair and desk assembly, that optionally includes a reading stand, book storage compartment and may be a rocking chair or stationary chair.

Still more particularly, the present invention relates to a combination desk and chair that is a "knock-down" or "ready-to-assemble" (RTA) chair capable of being simply and readily assembled without the need for any conventional fastening means, and being designed to function as either a steady chair embodiment or a rocking chair embodiment. The assembly can be readily disassembled and knocked down into a compact form for storage, transportation, or packaging.

2. Description of the Related Art

Conventional chairs include back, seat, and leg portions that are generally connected together permanently. As a result, such conventional chairs cannot readily be collapsed so as to occupy less space in storage and so as to be more easily transported from one location to another. Furniture of the knock down type that may be readily disassembled for storage and/or transportation or packaging has long been known. Usually the knock down furniture in the prior art employs fasteners of various types including threaded fasteners, dowels, or wedges to align and join the various parts into a completed assembly. Such knock-down furniture is known to the prior art and is advantageous from the viewpoint of both shipment and storage, as well as size. There are also chair designs known to the prior art which, in one orientation function as a steady chair and, in an alternative orientation, function as another type of chair, such as for example, a rocking chair.

It is, nevertheless, advantageous to provide a chair and desk assembly of knock-down design or ready-to-assemble (RTA) design capable of being simply and readily assembled and disassembled, without the need for conventional fasteners.

The following U.S. patents and Published Applications are representative of some of the known knock-down and ready-to-assemble (RTA) designs;

U.S. Pat. Nos. 4,419,028 and 4,867,327 to Roland discloses a knock down chair made from an assembly of interlocking planar members requiring no fasteners. The various members can be made from a single sheet of commercially available plywood and include first and second side members, a seat member, a pair of transverse seat support members, and a back member. The transverse seat support members are rotatingly interlocked to the side members, and the seat member is interlocked to the side members to hold the side members, the seat support members, and the seat in interlocking relationship. The back member is interlocked to the side members to complete the assembly.

U.S. Pat. No. 4,593,950 to Infanti discloses a child's knock-down chair capable of being assembled without the need for any conventional fasteners and comprised of two side parts and two cross pieces which act respectively as seat and back for a steady chair, and as a back and seat for a rocking chair.

U.S. Pat. No. 5,203,611 to Greenwood discloses a chair structure which can be used by young children either as a bouncer or as a rocker. The structure includes a frame member having a pair of transversely spaced, generally U-configured side portions and at least one seat member raised above a support surface. The frame member is oscillatable or rockable depending upon which one of the opposite end portions thereof is engaged with the support surface.

U.S. Pat. No. 5,275,467 to Kawecki discloses a knock-down chair kit which may be assembled without glue, nails, rivets or other fasteners. The kit is fabricated by means of laser cutting. The chair is made out of plywood, solid wood, wood composite, plastic, metal or other similar thin, flat stock. It uses a series of hooks, which hooks fit into slots having matched positions, in order to rigidly interlock the component members of the chair together and prevent them from pulling apart as well as flush mounted pegs.

U.S. Pat. No. 5,803,548 to Battle discloses a collapsible chair that includes a pair of planar side panels, a planar back panel, a planar seat panel and spacer elements, slots and lock-tabs.

U.S. Pat. Nos. 6,619,749, 6,807,912, U.S. Patent Application Publication No. 2003/0107254 and 2003/0107255 to Willy disclose a ready-to-assemble (RTA) furniture system that includes a collection of identically configured side panels, with sets of the side panels having different aesthetic and/or functional features, a collection of base panels and back panels spanning between pairs of side panels, the collection of base and back panels being provided in different sets of lengths and configurations to permit construction of different types of furniture. The panels are interconnected through a series of slots and notches. Locking members are provided that can lock the entire RTA furniture item together.

U.S. Patent Application Publication No. 2004/0000808 to Maloney discloses outdoor slat furniture having a pair of laterally spaced apart supports and slats disposed there between and connected thereto and in which the slats individually or in groups are snap fittingly connected to the supports in a rigid manner such that the furniture is rigid without the need for further reinforcement. The slats are connected to the supports by fingers projecting therefrom into recesses in the supports.

There is thus a need for a combination desk and chair that is a "knock-down" or "ready-to-assemble" (RTA) chair capable of being simply and readily assembled without the need for any conventional fastening means, having members formed from a single sheet of, for example, conventional plywood, that are assembled into interlocking relationship requiring no fasteners for the assembly.

OBJECTS AND SUMMARY OF INVENTION

It is a primary object of the present invention to provide a new and improved knock down chair.

It is a further object of the present invention to provide such a knock down chair and desk assembly which requires no fasteners for its assembly.

It is yet another object of the present invention to provide a new and improved knock down chair and desk assembly having components of a planar configuration that can be formed from a standard sized sheet of plywood.

It is yet a further object of the present invention to provide a new and improved knock down chair and desk assembly having interlocking joints arranged to prevent an accidental disassembly of the chair.

It is yet another object of this invention to provide a chair and desk assembly that simple and straightforward to assemble, each of the pieces of the chair assembly are planar pieces, thereby minimizing occupied volume and hence facilitating storage thereof.

It is another object of this invention to provide a chair and desk assembly wherein all parts needed to complete the main structure and accessories can be cut from a planar panel by electric hand tools or by standard cutting and milling machines.

All of the foregoing objects as well as others are achieved by the chair and desk assembly of this invention that is a "knock-down" or "ready-to-assemble" (RTA) structure having members formed from a single sheet of, for example, plywood, that are assembled into interlocking relationship requiring no fasteners for the assembly. The assembly can be readily disassembled and knocked down into a compact form for storage, transportation, or packaging. Optionally, the chair and desk assembly, includes a reading stand, book storage compartment and may be a rocking chair.

More particularly, the chair and desk assembly of this invention comprises:

a) a first side planar panel which includes:
   - a lower side panel portion having a front, rear, upper and lower region,
   - a middle side panel portion extending above the upper region from the front and rear regions of the lower side panel portion, and
   - an upper side panel portion extending from the upper and rear region;

b) a second side planar panel which includes:
   - a lower side panel portion having a front, rear, upper and lower region, and
   - an upper side panel portion extending from the upper and rear region, the lower and upper side panel portions of the first side panel being substantially identical in shape to the lower and upper side panel portions of the second side panel;

a first plurality of notches in each of the lower regions of each of the side panels;

a second plurality of notches in each of the upper regions of each of the side panels;

c) a plurality of lower planar cross-pieces that slidably mate and interlock with the first plurality of notches in the lower regions of each of the side panels;

d) a plurality of upper planar cross-pieces that slidably mate and interlock with the second plurality of notches in the upper regions of each of the side panels;

whereby the first and second side panels are interlocked with the upper and lower cross pieces and are substantially parallel to each other;

e) a planar seat panel having front and rear edges and side edges, the rear edge having a slot near each of the sides, each slot slidably mating with a slot in the upper side panel portion of each side panel when positioned on the upper cross-pieces, and having a slot near the front and side edges that slidably mates with the middle side panel portion extending above the upper region from the front region of the lower side panel portion, whereby the seat panel interlocks with the upper side panel portions;

f) a planar back panel having front and rear surfaces, top and bottom edges and side edges, the bottom edge having a projecting tongue which slidably mates with a slot near the rear edge of the seat panel, slots on each of the sides near the top edge which slidably mate with slots on each of the upper side panel portions, the upper side panels projecting from the rear of the back panel, whereby the back panel interlocks with the upper side panel portions and the seat panel;

g) an elongated planar desk support member having a first end and a second end and a top and bottom edge, the bottom edge having a slot near the first end of the support member which slidably mates with a slot in the middle side panel portion of the first side panel, the support member extending, toward the second panel, whereby the support member interlocks with the middle side panel portion;

h) a planar desk panel having a front, side and rear panel portions, the rear panel portion having a first slot and a second slot, the first slot slidably mating with a slot on the upper panel portion of the first side panel that extends from the rear of the back panel, the second slot slidably mating with a slot on the upper panel portion of the second side panel that extends from the rear of the back panel, the side panel portion of the desk panel resting on the middle side portion of the first side panel and the front panel portion of the desk panel resting on the top edge of the desk support member, whereby the desk panel interlocks with upper panel portions of the first and second side panels, wherein the side panels, upper and lower cross-pieces, seat panel, back panel desk support member, and desk panel interlock to provide a self supporting chair with desk.

As indicated, optionally, the chair and desk assembly may include a reading stand, book storage compartment and may be a rocking chair.

BRIEF DESCRIPTION OF THE DRAWINGS

In the drawing, like reference numbers refer to like parts throughout the several views, and wherein.

For a more complete understanding of the present invention, reference may be had to the following description of the exemplary preferred embodiments of the present invention considered in connection with the accompanying drawings, of which.

DETAILED DESCRIPTION OF THE INVENTION

Figure 1:
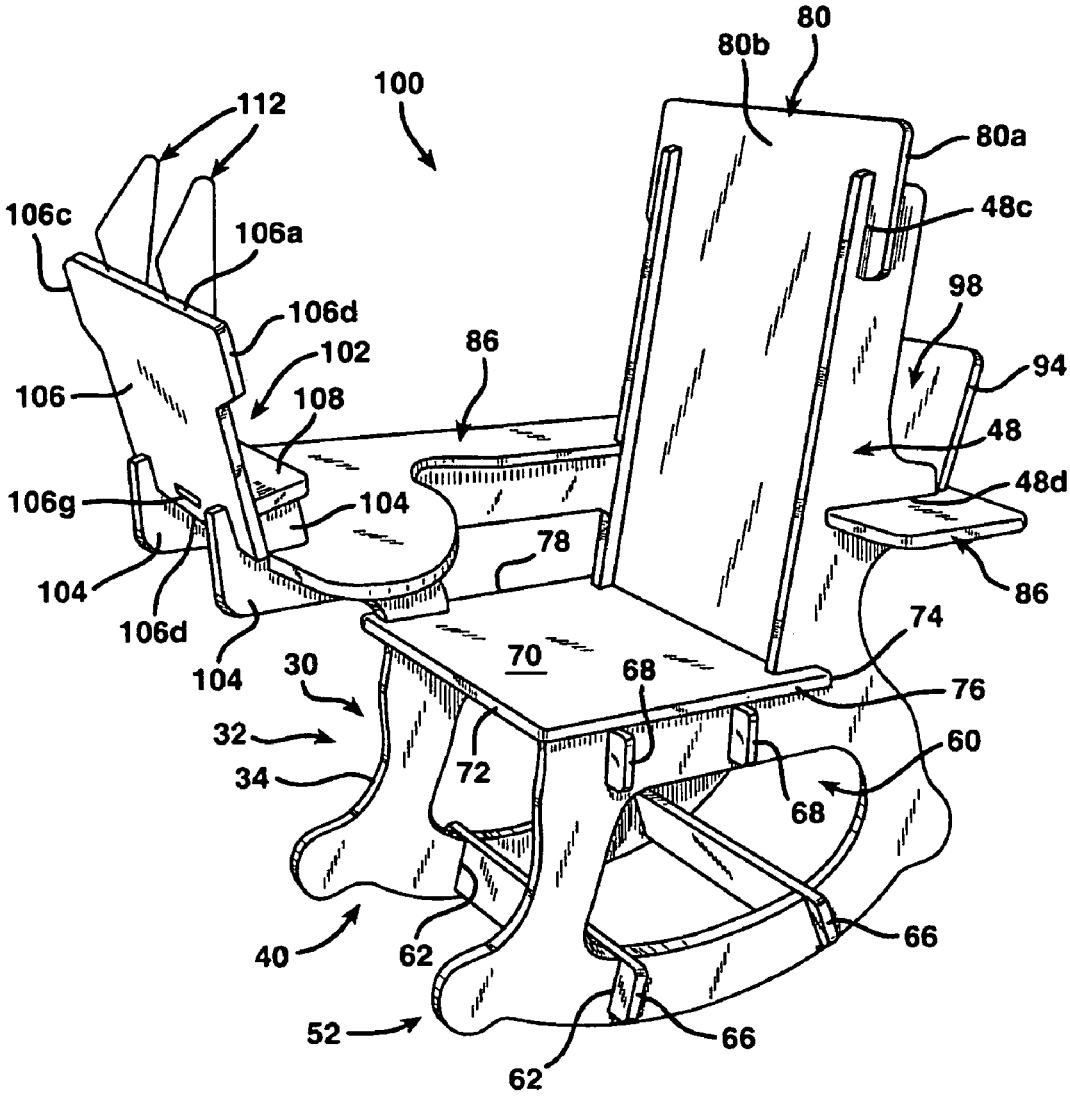
FIG. 1 is a perspective view of one embodiment of the chair and desk assembly of this invention.

Referring to FIGS. 1–19, an embodiment of a chair and desk assembly 100 is depicted. Referring to FIGS. 1–8, the assembly 100 comprises a first side planar panel 30.

Referring to FIGS. 1–8, this panel 30 includes a lower side panel portion 32 having a front 34, rear 36, upper 38 and lower 40 region. A middle side panel portion 42 of first side panel 30 extends above the upper region 38 from the front 34 and rear regions 36 of the lower side panel portion 32. Preferably, both the lower and middle side panel portions have an opening 44*a* and 44*b* therein both for aesthetic reasons as well as saving materials and a light structure, although the openings may not be present. An upper side panel portion 46 extends from the upper 38 and rear region 36.

Figure 7:
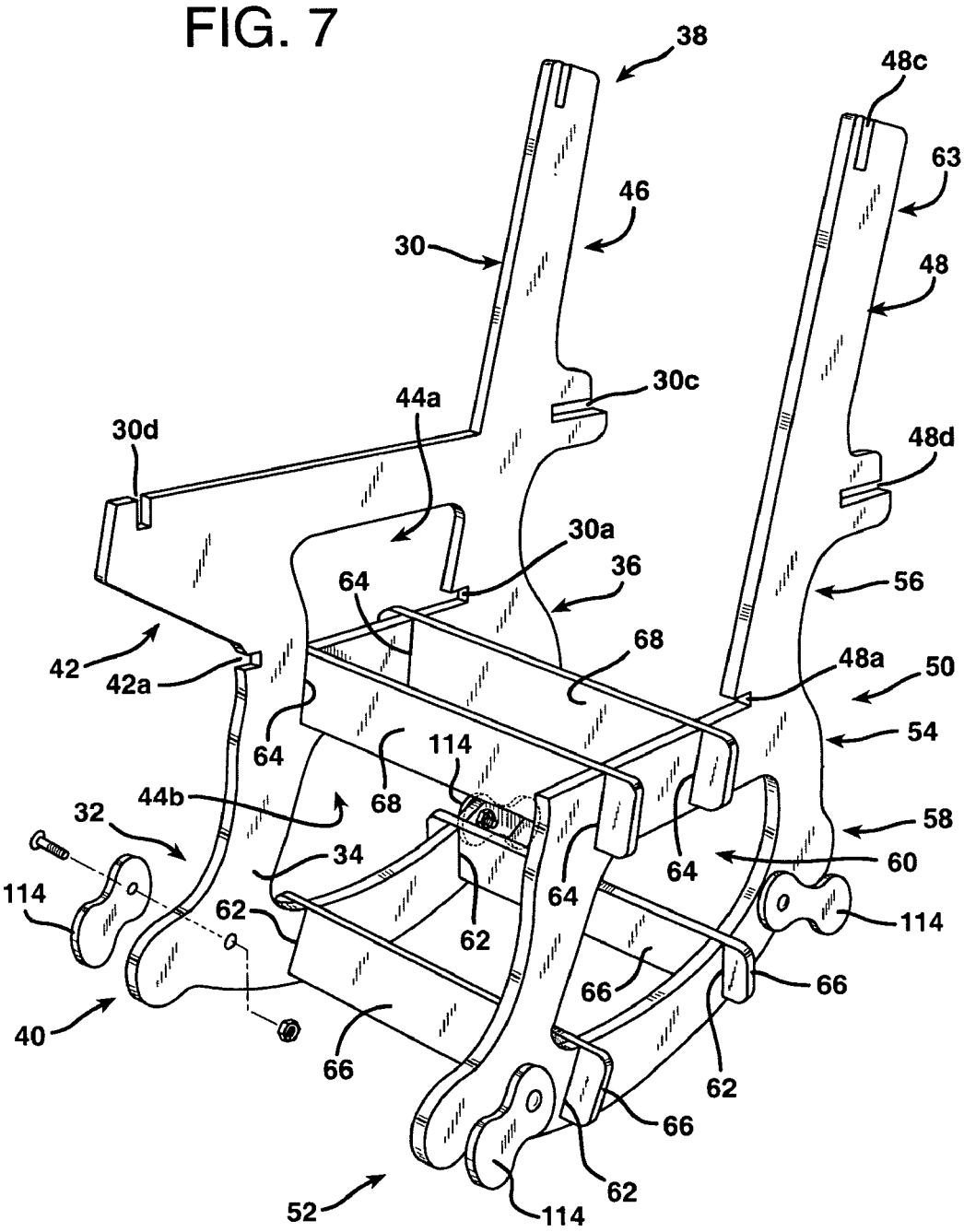
FIG. 7 is a perspective view of the chair and desk assembly of this invention with the desk panel removed.
Figure 9:
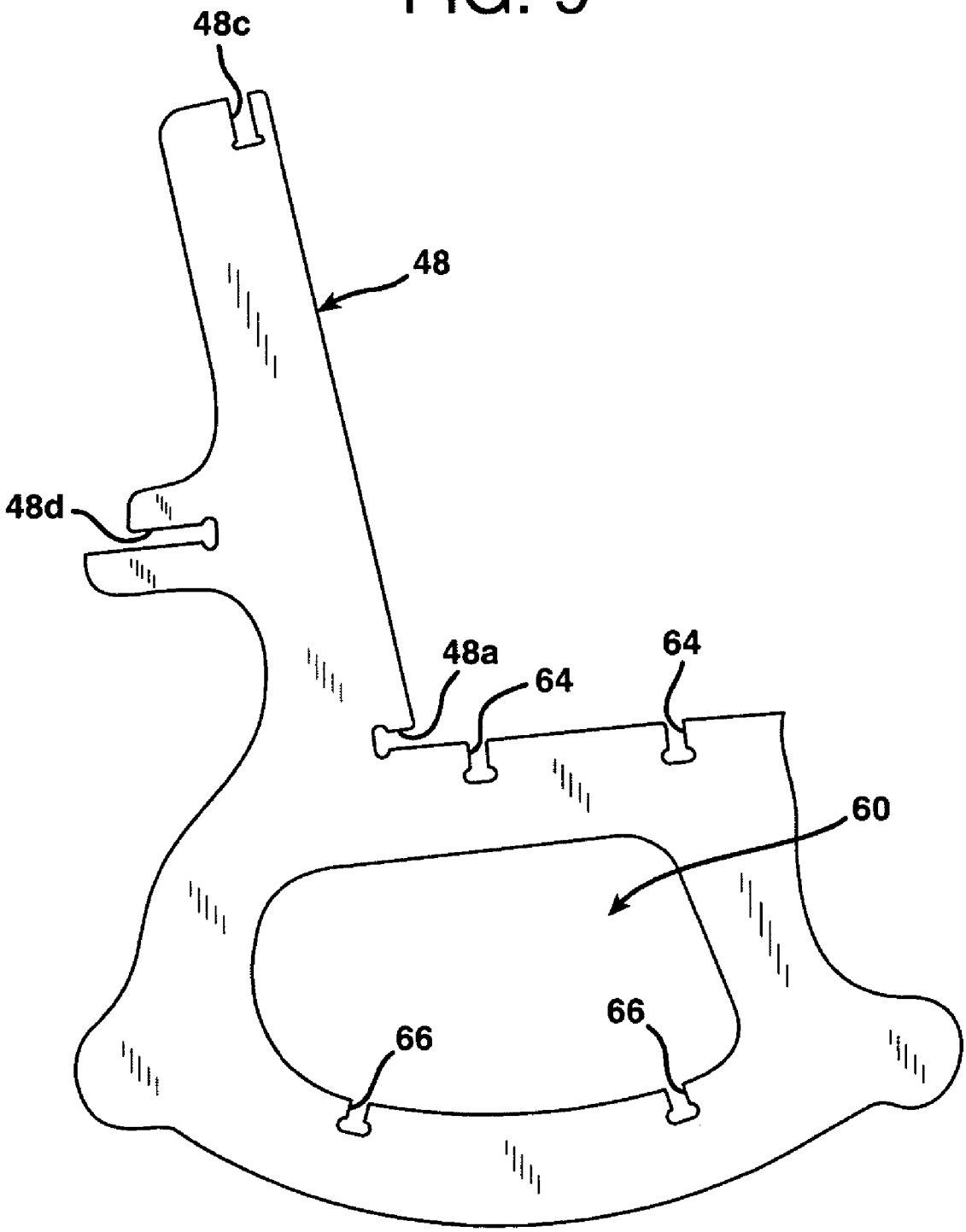
FIG. 9 is a plan view of the second side panel used in the chair and desk assembly of this invention.
Figure 10:
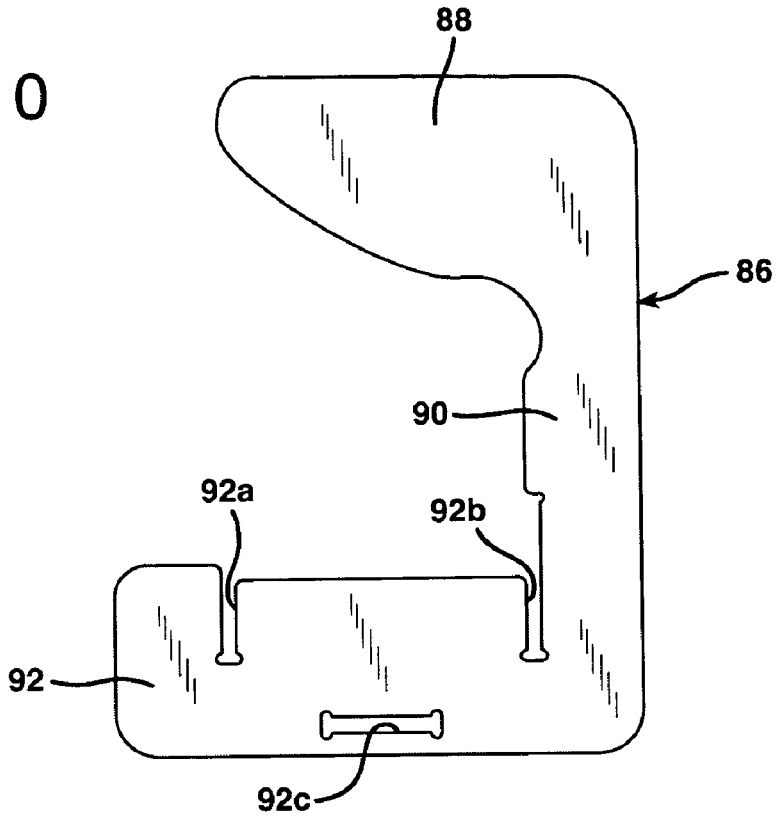
FIG. 10 is a plan view of the desk panel used in the chair and desk assembly of this invention.
Figure 11:
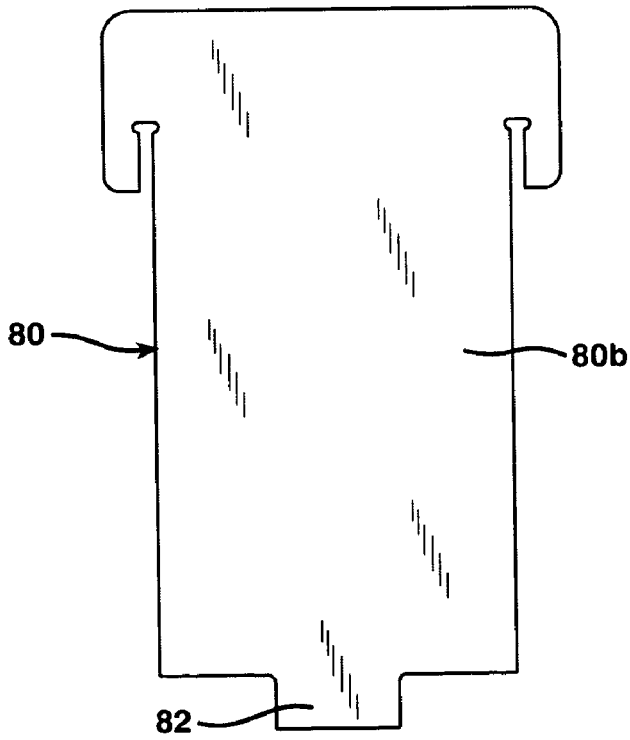
FIG. 11 is a plan view of the back panel used in the chair and desk assembly of this invention.
Figure 12:
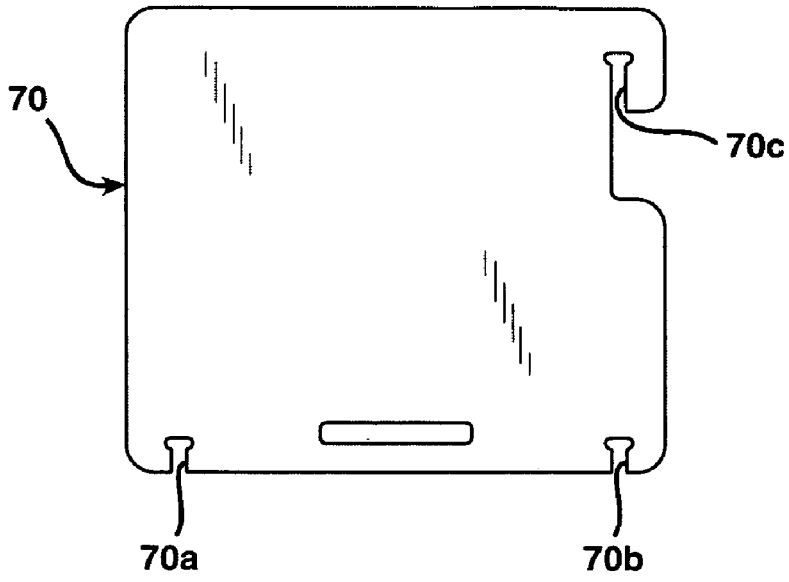
FIG. 12 is a plan view of the seat panel used in the chair and desk assembly of this invention.

Referring to FIGS. 7 and 9, a second side planar panel 48 is provided. This panel includes lower side panel portion 50 having a front 52, rear 54, upper 56 and lower region 58. Preferably, the lower side panel portion has an opening 60 therein both for aesthetic reasons as well as saving materials and a light structure, although the opening may not be present. An upper side panel portion 63 extends from the upper 56 and rear region 54.

Preferably, for aesthetic as well as structural reasons the lower and upper side panel portions 32,46 of the first side panel 30 are substantially identical in shape to the lower and upper side panel portions 50, 62 of the second side panel 48.

Preferably, the lower regions 40, 58 of the first and second side panels 30, 48 are curved upward to provide a chair that rocks, see FIGS. 1, and 7–9.

Figure 8:
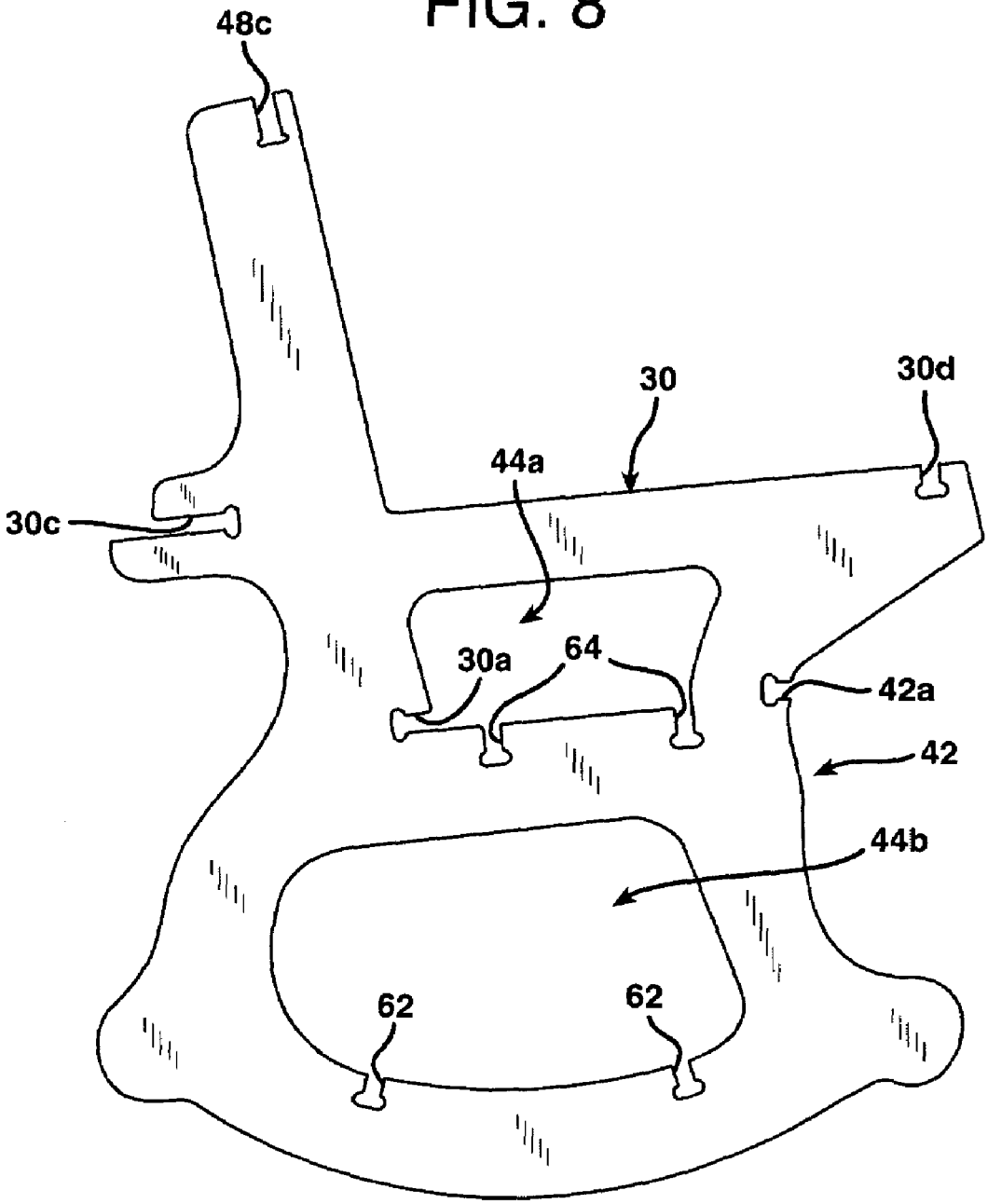
FIG. 8 is a plan view of the first side panel used in the chair and desk assembly of this invention.

Referring to FIGS. 7–9, a first plurality of notches 62 are provided in each of the lower regions 40, 58 of each of the side panels 30, 48. A second plurality of notches 64 are provided in each of the upper regions 38, 56 of each of the side panels 30,48.

Referring to FIGS. 1–7 a plurality of lower planar cross-pieces 66 are provided that slidably mate and interlock with the first plurality of notches 62 in the lower regions 40, 58 of each of the side panels 30, 48. Likewise, a plurality of upper planar cross-pieces 68 are provided that slidably mate and interlock with the second plurality of notches 64 in the upper regions 38, 56 of each of the side panels 30, 48.

Thus, the first and second side panels 30, 48 are interlocked with the upper and lower cross pieces 66, 68 and are substantially parallel to each other. The first and second side panels 30, 48 can be interchanged with each other to provide identical assemblies 100 that have the desk panel 86 on the right side, see for example FIG. 1 or on the left side.

Figure 13:
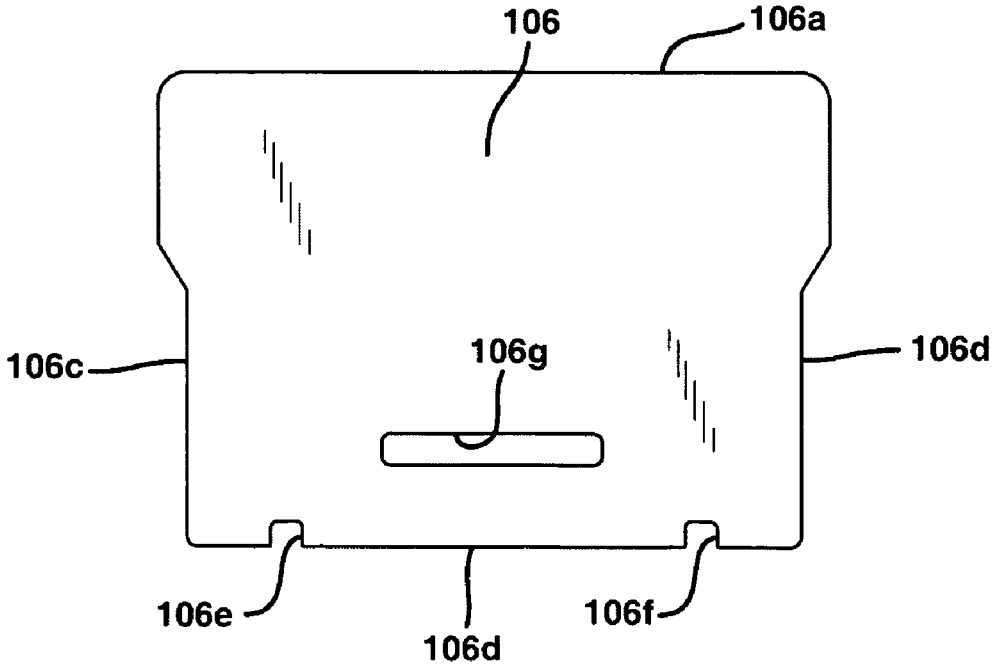
FIG. 13 is a plan view of the book rest panel used in the chair and desk assembly of this invention.
Figure 14:
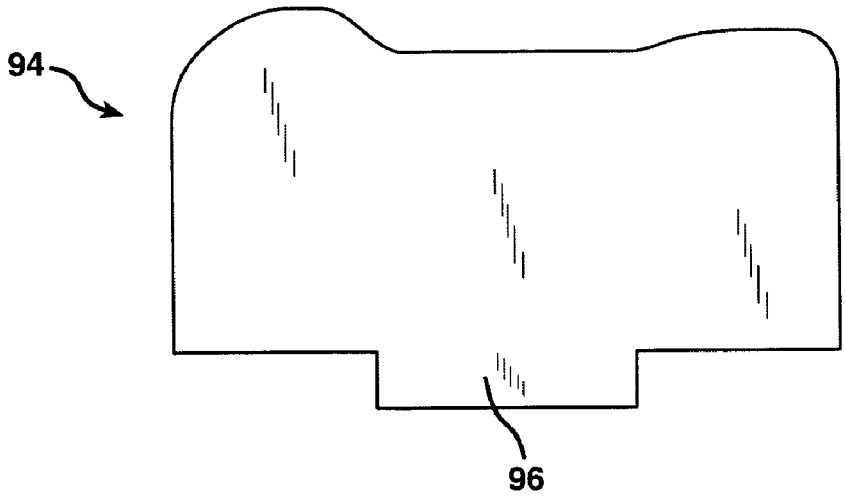
FIG. 14 is a plan view of the storage panel element used in the chair and desk assembly of this invention.
Figure 15:
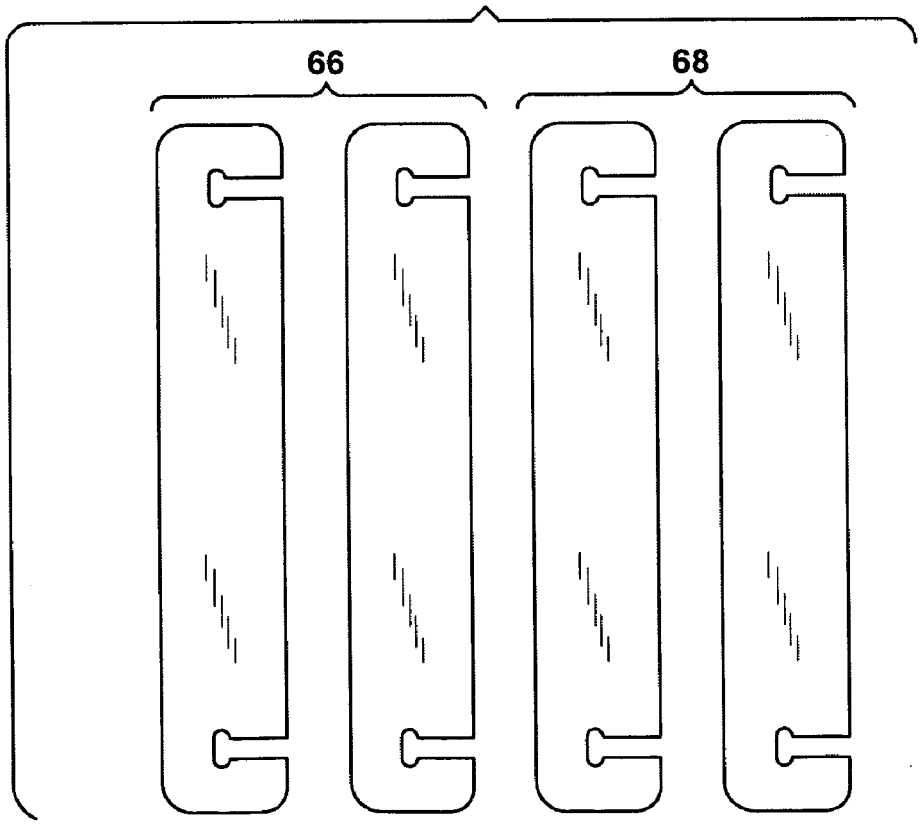
FIG. 15 is a plan view of the cross-pieces used in used in the chair and desk assembly of this invention.
Figure 17:
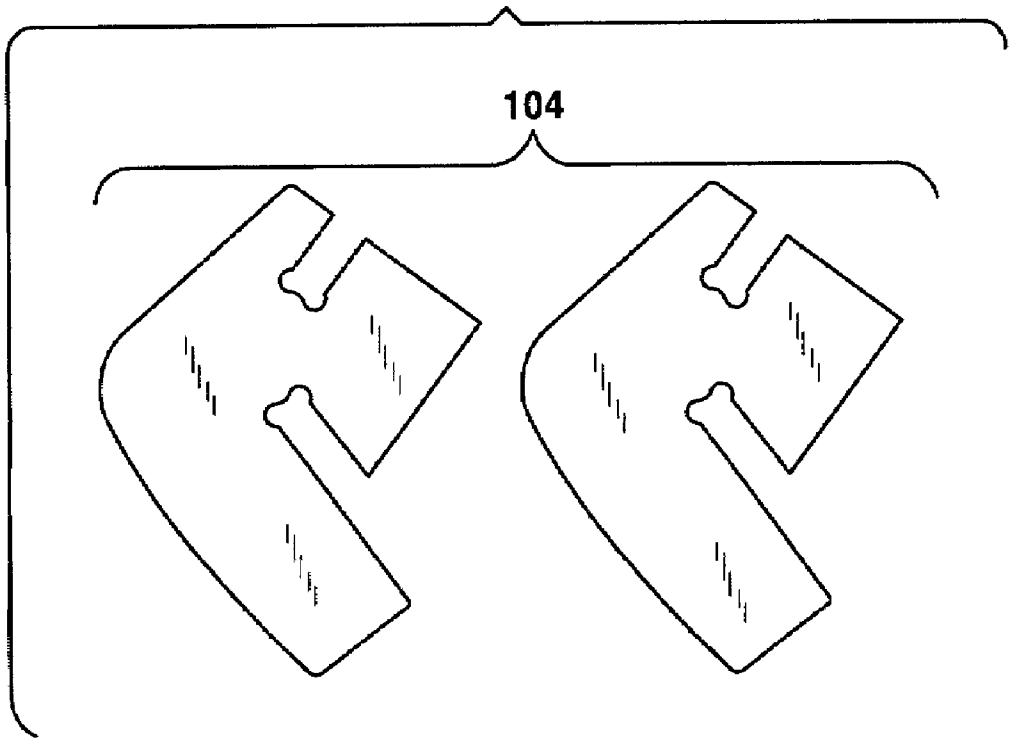
FIG. 17 is a plan view of the pedestal elements of the book stand used in the chair and desk assembly of this invention.

Referring to FIGS. 1–6 and 12, for example, a planar seat panel 70 is provided that has front 72 and rear edges 74 and side edges 76, 78. The rear edge 74 of the seat panel 70 has a slot 70*a*, 70*b* near each of the sides 76, 78. Each slot 70*a*, 70*b* slidably mates with a slot 30*a*, 48*a* in the upper side panel portion of each side panel 30, 48 when positioned on the upper cross-pieces 68. Referring to FIG. 17, a slot 70*c* is provided near the front and side edges 72, 70 of the seat panel 70. Referring to FIG. 13, slot 70*c* slidably mates with the middle side panel portion 42 extending above the upper region 38 from the front region 34 of the lower side panel portion 32. Preferably, slot 70*c* slidably mates with slot 42*a* locking the seat panel 70 with the upper side panel portions 46, 63 and the middle side panel portion 42.

Referring to FIGS. 1–6 and 11, a planar back panel 80 is provided. The back panel 80 has front and rear surfaces 80*a*, 80*b*, top and bottom edges 80*c*, 80*d* and side edges 80*e*, 80*f*. The back panel 80 further has projecting from the bottom edge 80*d*, a tongue 82 which slidably mates with a slot 70*d* near the rear edge 74 of the seat panel 70. Slots 80*h*, 80*g* are provided on each of the sides 80*e*, 80*f* near the top edge 80*c* of the back panel 80. Slots 80*h*, 80*g* slidably mate with slots 30*c* and 48*c* on each of the upper side panel portions 46, 63 of the first and second side panels 30 and 48, whereby the back panel 80 interlocks with the upper side panel portions 46, 63 and the seat panel 70.

Referring to FIGS. 2–4, 6 and 18, an elongated planar desk support member 84 is provided having a first end 84*a* and a second end 84*b* and a top and bottom edge 84*c*, 84*d*, respectively. The bottom edge 84*d* of the support member 84 is provided with a slot 84*e* near the first end 84*b* of the support member 84 which slidably mates with a slot 30*d* in the middle side panel portion 42 of the first side panel 30 (see FIG. 7). The support member 84 extends toward the second panel 48 and interlocks with the middle side panel portion 42.

Referring to FIGS. 1–6 and 10, a planar desk panel 86 is provided. The desk panel has front 88, side 90 and rear panel 92 portions. The rear panel portion 92 has a first slot and a second slot 92*a*, 92*b*. Referring to FIGS. 7 and 8, the first slot 92*a* slidably mates with a slot 30*c* on the upper panel portion 46 of the first side panel 30 that extends from the rear 80*b* of the back panel 80. The second slot 92*b* slidably mates with a slot 48*d* on the upper panel portion 63 of the second side panel 48 that extends from the rear 80*b* of the back panel 80. The side panel portion 90 of the desk panel 86 rests on the middle side portion 42 of the first side panel 30 and the front panel portion 88 of the desk panel 86 rests on the top edge 84*c* of the desk support member 84 (see FIGS. 2–4 and 6). The desk panel 86 slidably interlocks with upper panel portions 46, 63 of the first and second side panels 30, 48. The desk panel 86 thus has the capability of sliding forward or back to accommodate different sized persons.

After all the planer members are assembled, i.e., the side panels 30, 48, upper and lower cross-pieces 66, 68, seat panel 70, back panel 80, desk support member 84, and desk panel 86, they interlock to provide a self supporting chair with desk 100.

Referring to FIGS. 1–3 and 14, the chair and desk assembly 100 may further include a planar storage panel 94 having top 94*a*, bottom 94*b* and side edges 94*c*, 94*d*. The bottom edge 94*b* has a projecting tongue 96 which slidably mates and interlocks with a slot 92*c* in the rear panel portion 92 of the desk panel 86 (see FIGS. 2–3, and 7). The positioning of the storage panel 94 in such a manner forms a storage compartment 98 between the storage panel 94, the rear panel portion 92 of the desk panel 86, and the rear 80*b* of the back panel 80.

Figure 2:
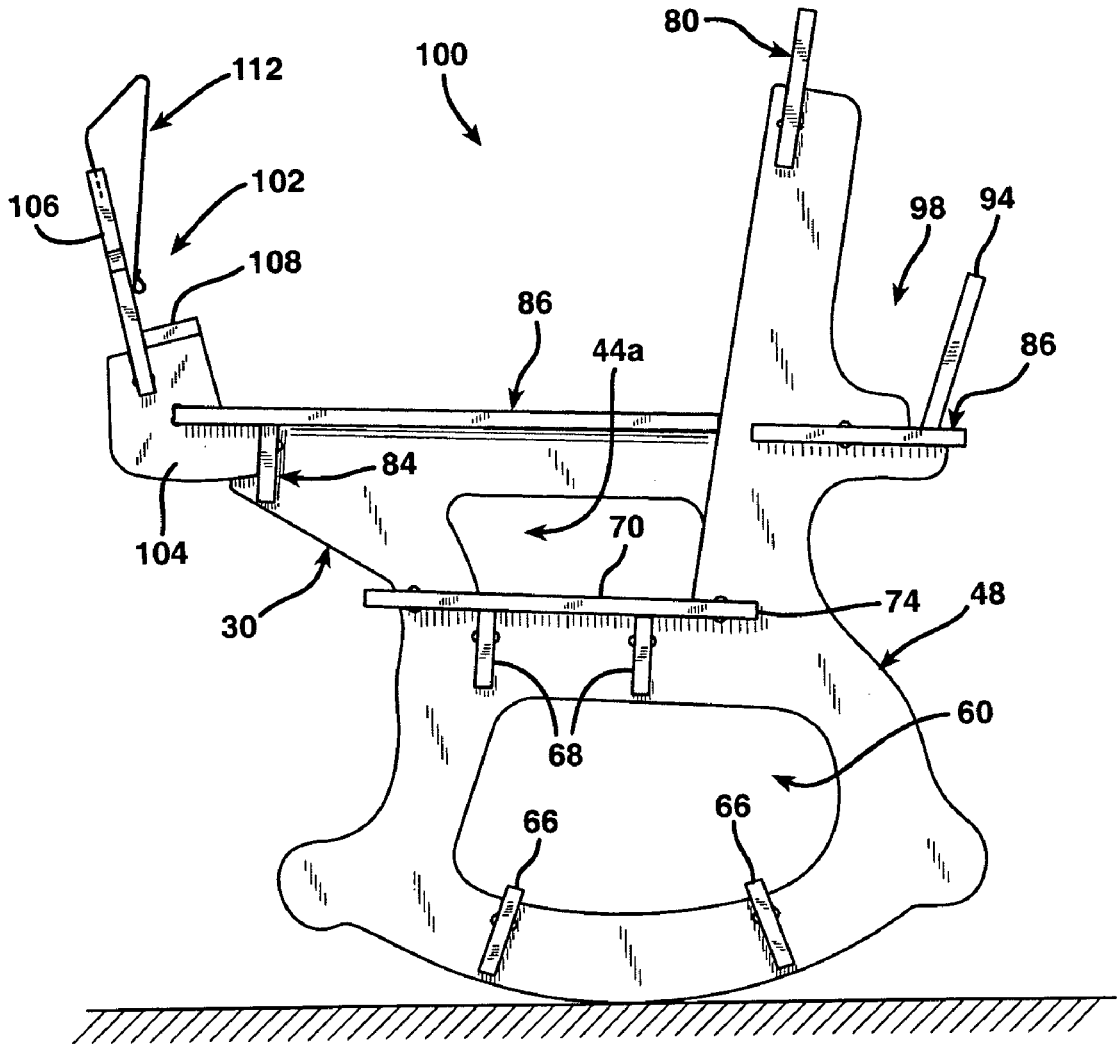
FIGS. 2–4 are side views of the chair and desk assembly shown in FIG. 1.
Figure 3:
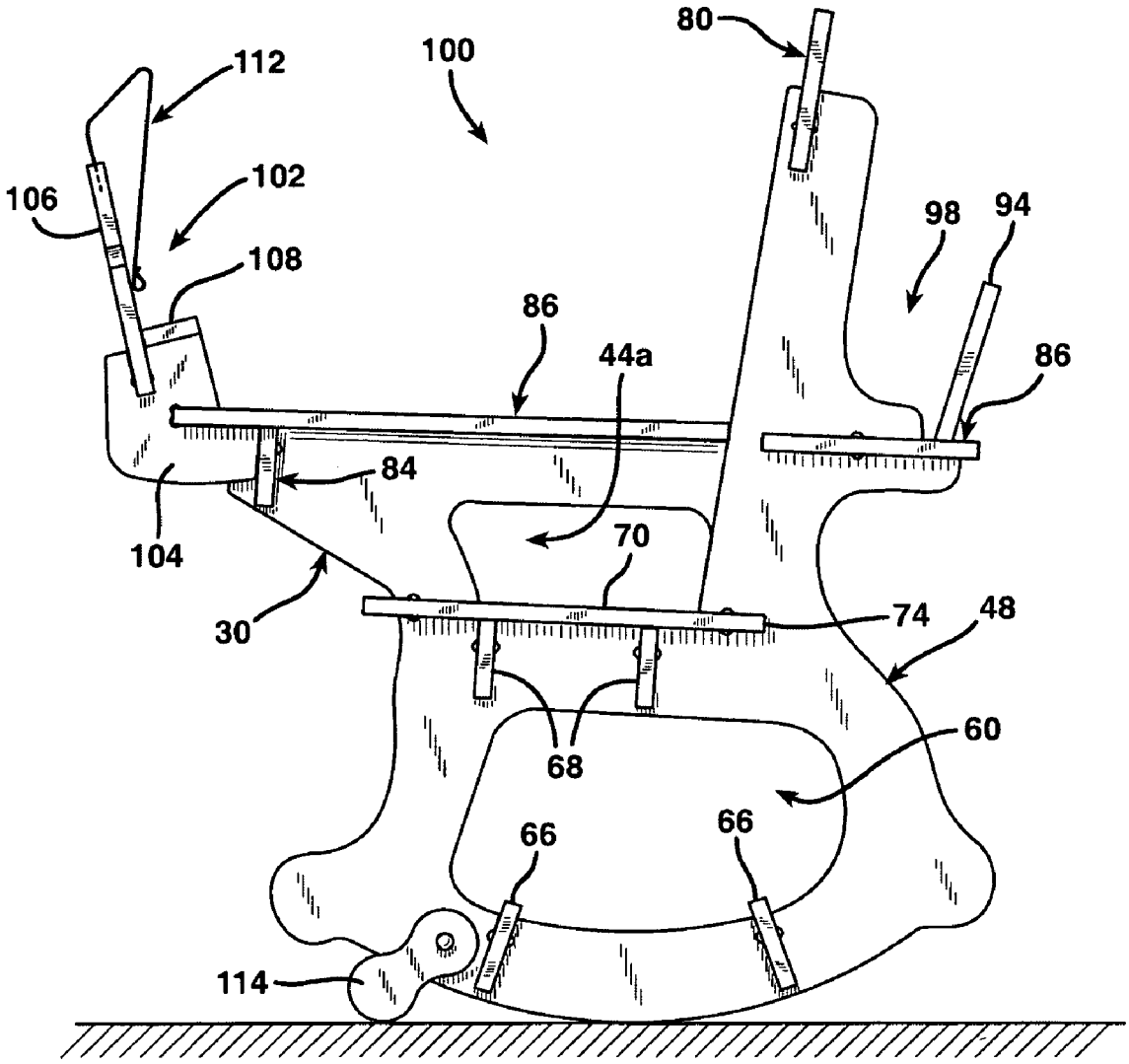
Figure 4:
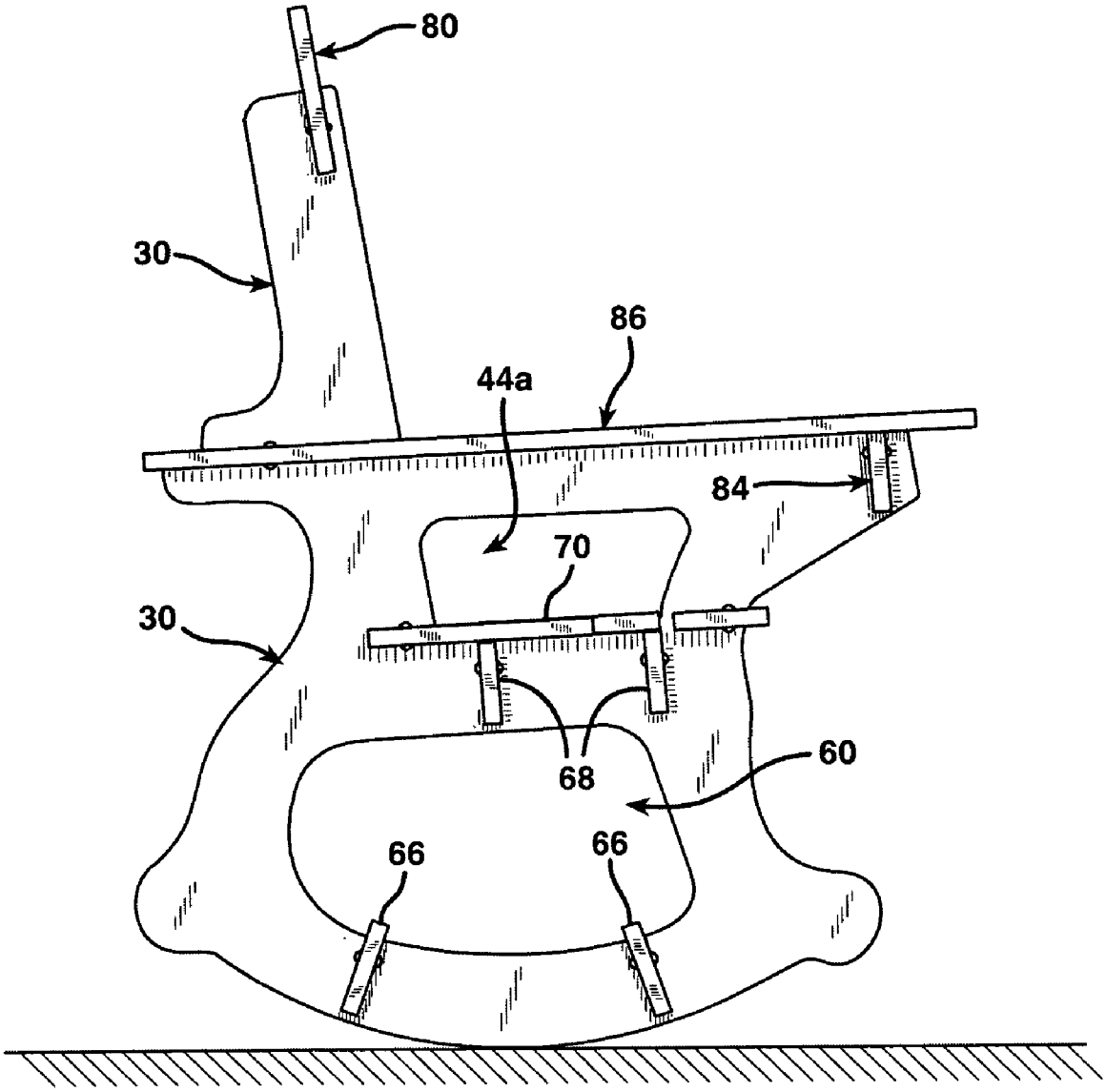
Figure 5:
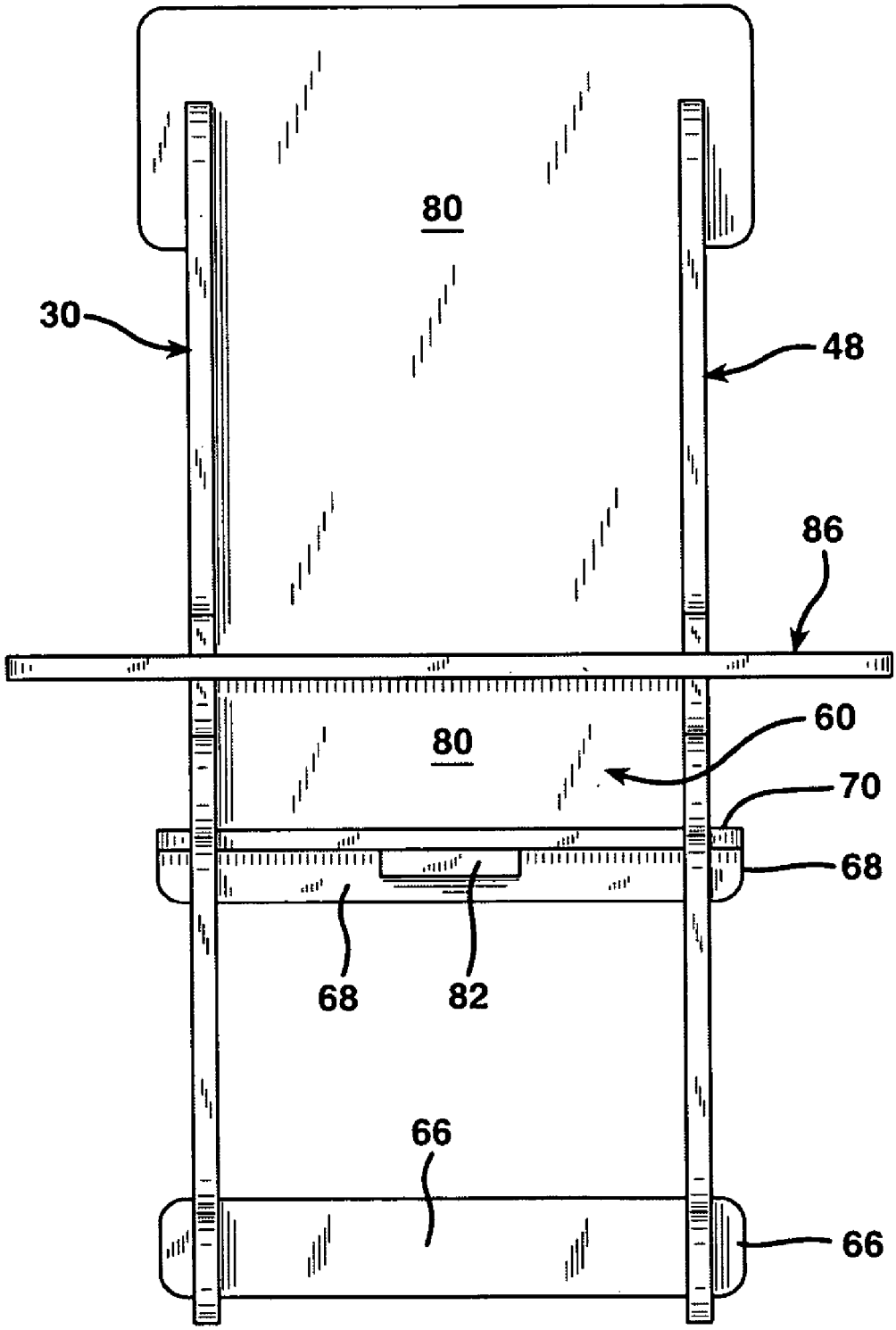
FIGS. 5–6 are rear views of the chair and desk assembly of this invention.
Figure 6:
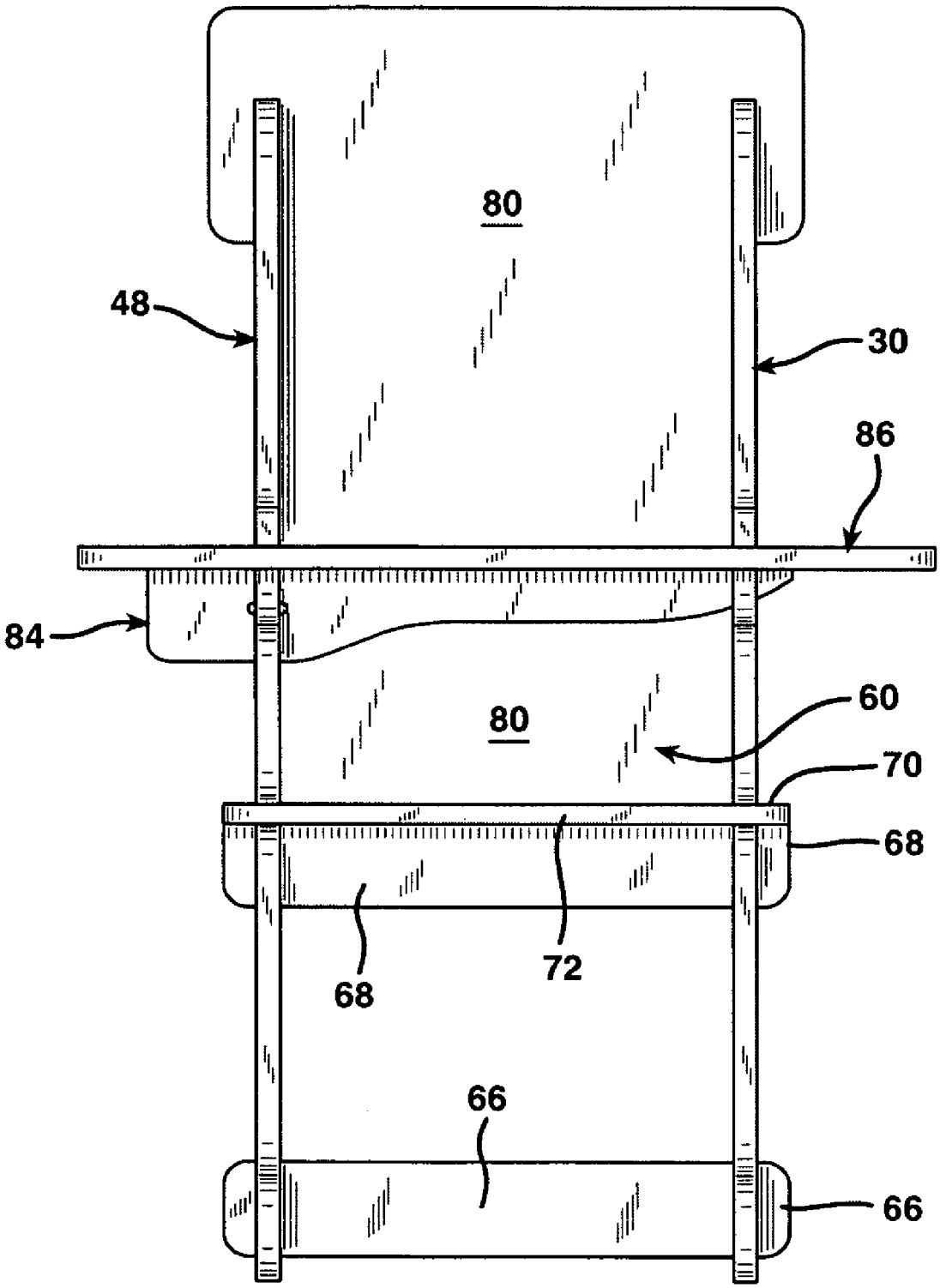
Figure 16:
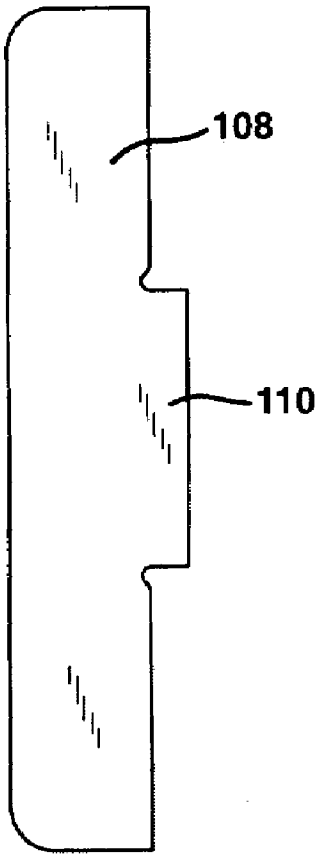
FIG. 16 is a plan view the book support member used in the chair and desk assembly of this invention.
Figure 18:
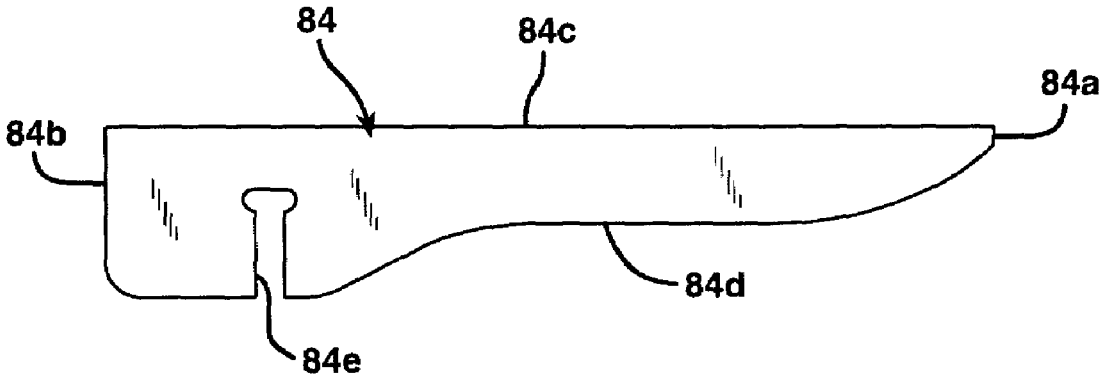
FIG. 18 is a plan view of the desk support member used in the chair and desk assembly of this invention.

Referring to FIGS. 1–3, the chair and desk assembly 100 may further include a book rest compartment 102 removably interlocked to the desk panel 86 on the front panel portion 88 thereof. The book rest compartment 102 includes a plurality of planar pedestals 104, each pedestal has a slot 104*a* that mates with an edge of the front panel portion 88 of the desk panel 86. The compartment 102 further includes a planar book rest panel 106 that has a top, bottom and side edges, 106*a*, 106*b*, 106*c*, 106*d* respectively. The bottom edge 106*b* slidably mates with the slots 104*a* the pedestals 104. Optionally, the bottom edge 106*b* may have slots 106*e* and 106*f* that mate with both pedestal slots 104*a* to interlock therewith. Referring to FIG. 16, the book rest compartment 102 further includes a planar book support member 108 that has a tongue 110 thereon that projects from and slidably mates with a slot 106*g*, the support member 108 projecting substantially perpendicular from the book rest panel 106. In use, a book rests on the book rest panel 106 for reading and is supported by the book support member 108 on the bottom thereof. Optionally, the book rest panel 106 may have a spring mechanism 112 attached to the top of the panel 106 to maintain the book in position (see FIGS. 1–3).

Figure 19:
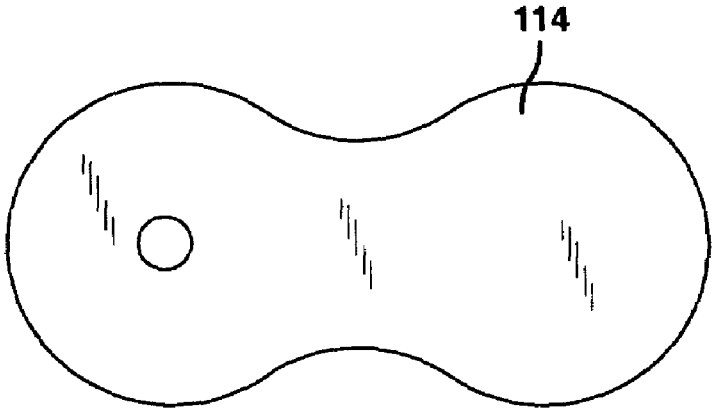
FIG. 19 is a plan view of the rocker top means used in the chair and desk assembly of this invention.

Referring to FIGS. 3, 7 and 19, if the chair and desk assembly 100 is a rocking chair, the assembly may further include stop means 112 associated with at least one of the lower regions 40 or 58 for preventing the chair from rocking. Preferably, as depicted in FIG. 25 there are four such stop means mounted (e.g., pinned) onto the lower regions 40, 58.

As indicated previously, one of the of this invention is that all of the elements (except for spring mechanism) of the chair assembly 100 may each be planar and made from a substantially flat sheet of a suitable rigid material. Thus, the components of the assembly 100 of this invention can be made from inexpensive, durable, and light weight wood and plastic materials. A variety of stains or paints can be used. For example, all the modular parts needed to complete the structure herein may be made from a single standard sheet of three quarter inch thick plywood having dimensions of 48 inches by 96 inches. However, more than one planar sheet may be used to form the elements.

The stock from which all of the planar members are formed preferably is thin plywood. However, cardboard, plastic, metal or the like might be useful in some applications. Thin plywood is especially amenable to precision laser cutting. This method of forming the pieces is quick and inexpensive. More significantly, laser cutting is particularly accurate, and the achievement of precise tolerances is important in making a chair that is steady and durable. However, stamping, casting, molding or other alternate methods, such as nested base, computer guided router milling machines can be used to make the planar elements used in this invention.

From the foregoing description, assembly is straightforward. For example, the side panels 30, 48 are connected to each other with the upper and lower cross pieces 66, 68. The seat panel 70 is then positioned thereon followed by the back panel 80. The desk support member 84 is then interlocked with side panel 30 and the desk panel 86 positioned on the structure and locked in place. Storage panel 106 is then positioned in the rear of the assembly followed by assembly of the book rest compartment 102, i.e., positioning of the pedestal 104, book rest panel 106, support member 108 and spring mechanism 112.

The chair and desk assembly can be shipped and sold un-assembled, preferably in a carton in which the elements are compactly stacked one on top of the other. Thus, it can be shipped and displayed in a very small area, which is of significant concern to merchants. After assembly, it can be disassembled and reassembled over and over. It can be stored in its disassembled state in a minimum amount of space, which is of significant concern to many consumers, such as apartment dwellers.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

These claims, and the language used therein, are to be understood in terms of the variants of the invention which have been described. They are not to be restricted to such variants, but are to be read as covering the full scope of the invention as is implicit within the invention and the disclosure.

What is claimed:

1. A chair and desk assembly comprising:

a) a first side planar panel which includes:

a lower side panel portion having a front, rear, upper and lower region, a middle side panel portion extending above the lower region from the front and rear regions of the lower side panel portion, and an upper side panel portion extending from the upper and rear region;

b) a second side planar panel which includes:

a lower side panel portion having a front, rear, upper and lower region, and an upper side panel portion extending from the upper and rear region, the lower and upper side panel portions of the first side panel being substantially identical in shape to the lower and upper side panel portions of the second side panel;

a first plurality of notches in each of the lower regions of each of the side panels;

a second plurality of notches in each of the upper regions of each of the side panels;

c) a plurality of lower planar cross-pieces that slidably mate and interlock with the first plurality of notches in the lower regions of each of the side panels;

d) a plurality of upper planar cross-pieces that slidably mate and interlock with the second plurality of notches in the upper regions of each of the side panels;

whereby the first and second side panels are interlocked with the upper and lower cross pieces and are substantially parallel to each other;

e) a planar seat panel having front and rear edges and side edges, the rear edge having a slot near each of the sides, each slot slidably mating with a slot in the upper side panel portion of each side panel when positioned on the upper cross-pieces, and having a slot near the front and side edges that slidably mates with the middle side panel portion extending above the upper region from the front region of the lower side panel portion, whereby the seat panel interlocks with the upper side panel portions;

f) a planar back panel having front and rear surfaces, top and bottom edges and side edges, the bottom edge having a projecting tongue which slidably mates with a slot near the rear edge of the seat panel, slots on each of the sides near the top edge which slidably mate with slots on each of the upper side panel portions, the upper side panels projecting from the rear of the back panel, whereby the back panel interlocks with the upper side panel portions and the seat panel;

g) an elongated planar desk support member having a first end and a second end and a top and bottom edge, the bottom edge having a slot near the first end of the support member which slidably mates with a slot in the middle side panel portion of the first side panel, the support member extending toward the second panel, whereby the support member interlocks with the middle side panel portion;

h) a planar desk panel having a front, side and rear panel portions, the rear panel portion having a first slot and a second slot, the first slot slidably mating with a slot on the upper panel portion of the first side panel that extends from the rear of the back panel, the second slot slidably mating with a slot on the upper panel portion of the second side panel that extends from the rear of the back panel, the side panel portion of the desk panel resting on the middle side portion of the first side panel and the front panel portion of the desk panel resting on the top edge of the desk support member, whereby the desk panel interlocks with upper panel portions of the first and second side panels, wherein the side panels, upper and lower cross-pieces, seat panel, back panel desk support member, and desk panel interlock to provide a self supporting chair with desk.

2. The chair of claim 1, further comprising a planar storage panel section having top, bottom and side edges, the bottom edge having a projecting tongue which slidably mates and interlocks with a slot in the rear panel portion of the desk panel, whereby a storage compartment is formed between the storage panel, the rear panel portion of the desk panel, and the rear of the back panel.

3. The chair of claim 1, further comprising a book rest compartment removably interlocked to the desk panel on the front panel portion.

4. The chair of claim 3, wherein the book rest compartment comprises:

a plurality of planar pedestals, each pedestal having a slot that mates with an edge of the front panel portion of the desk panel;

a planar book rest panel have a top, bottom and side edges, the bottom edge slidably mating with a slot in each of the pedestals, a planar book support member having a tongue thereon that slidably mates with a slot, the support member projecting substantially perpendicular from the book rest panel, wherein a book rests on the book rest panel for reading and is supported by the book support member on the bottom thereof.

5. The chair of claim 1, wherein the lower regions of the first and second side panels are curved upward to provide a chair that rocks.

6. The chair of claim 5, further comprising stop means for preventing the chair from rocking associated with the lower regions.

7. A chair and desk assembly, comprising:

a) a first side panel which includes:

a lower side panel portion having a front, rear, upper and lower region, a middle side panel portion extending above the lower region from the front and rear regions of the lower side panel portion, and an upper side panel portion extending from the upper and rear region;

b) a second side panel which includes:

a lower side panel portion having a front, rear, upper and lower region, and an upper side panel portion extending from the upper and rear region, c) at least one lower cross-piece that slidably mates and interlocks with at least one notch in the lower region of each of the side panels;

d) at least one upper cross-piece that slidably mates and interlocks with at least one notch in the upper region of each of the side panels;

whereby the first and second side panels are interlocked with the upper and lower cross piece and are substantially parallel to each other;

e) a seat panel having front and rear edges and side edges, the rear edge having a slot near each of the sides, each slot slidably mating with a slot in the upper side panel portion of each side panel when positioned on the upper cross-piece, and having a slot near the front and side edges that slidably mates with the middle side panel portion extending above the upper region from the front region of the lower side panel portion, whereby the seat panel interlocks with the upper side panel portions;

f) a back panel having front and rear surfaces, top and bottom edges and side edges, the bottom edge having a projecting tongue which slidably mates with a slot near the rear edge of the seat panel, slots on each of the sides near the top edge which slidably mate with slots on each of the upper side panel portions, the upper side panels projecting from the rear of the back panel, whereby the back panel interlocks with the upper side panel portions and the seat panel;

g) an elongated desk support member having a first end and a second end and a top and bottom edge, the bottom edge having a slot near the first end of the support member which slidably mates with a slot in the middle side panel portion of the first side panel, the support member extending toward the second panel, whereby the support member interlocks with the middle side panel portion;

h) a desk panel having a front, side and rear panel portions, the rear panel portion having a first slot and a second slot, the first slot slidably mating with a slot on the upper panel portion of the first side panel that extends from the rear of the back panel, the second slot slidably mating with a slot on the upper panel portion of the second side panel that extends from the rear of the back panel, the side panel portion of the desk panel resting on the middle side portion of the first side panel and the front panel portion of the desk panel resting on the top edge of the desk support member, whereby the desk panel slidably interlocks with upper panel portions of the first and second side panels, wherein the side panels, upper and lower cross-pieces, seat panel, back panel desk support member, and desk panel interlock to provide a self supporting chair with desk.

8. The chair assembly of claim 1, wherein all of the planar elements of the chair assembly are each formed from a substantially flat sheet of a suitable rigid material.

9. The chair assembly of claim 8, wherein the rigid material is wood or plastic.

10. The chair assembly of claim 7, wherein the desk panel slides forward and back in the slots in the upper panel portions of the first and second side panels.

* * * * *